US012128324B2

(12) United States Patent
Grabietz et al.

(10) Patent No.: US 12,128,324 B2
(45) Date of Patent: Oct. 29, 2024

(54) METHOD OF OPERATING A RIDE AND A RIDE

(71) Applicant: Mack Rides GmbH & Co. KG, Waldkirch (DE)

(72) Inventors: Christian Grabietz, Bremen (DE); Dennis Gordt, Sexau (DE); Maximilian Röser, Müllheim (DE); Stephan Alt, Waldkirch-Kollnau (DE); Maurice Kremer, Freiburg (DE); Julian Föhles, Herbolzheim (DE); Joschka Gewald, Gutach (DE); Thorsten Köbele, Riegel (DE); Sascha Rigling, Waldkirch (DE)

(73) Assignee: MACK RIDES GMBH & CO. KG, Waldkirch (DE)

( * ) Notice: Subject to any disclaimer, the term of this patent is extended or adjusted under 35 U.S.C. 154(b) by 339 days.

(21) Appl. No.: 17/586,008

(22) Filed: Jan. 27, 2022

(65) Prior Publication Data

US 2022/0233965 A1 Jul. 28, 2022

(30) Foreign Application Priority Data

Jan. 27, 2021 (DE) ..... 102021101864.1

(51) Int. Cl.
*A63G 25/00* (2006.01)
*A63F 9/02* (2006.01)
(Continued)

(52) U.S. Cl.
CPC ..... *A63G 25/00* (2013.01); *A63F 9/0243* (2013.01); *A63F 9/0252* (2013.01);
(Continued)

(58) Field of Classification Search
CPC ..... A63G 25/00; A63G 31/007; A63G 33/00; A63F 9/0243; A63F 9/0252; A63F 9/0278
(Continued)

(56) References Cited

U.S. PATENT DOCUMENTS 6,220,965 B1 4/2001 Hanna et al.
2007/0135218 A1 6/2007 Williams et al.
(Continued)

FOREIGN PATENT DOCUMENTS

CN 2323836 Y 6/1999
DE 102013101292 A1 8/2014
(Continued)

OTHER PUBLICATIONS

Search report issued on Jun. 9, 2022, in parallel European patent application No. 21 210 913.6.
(Continued)

*Primary Examiner* — Kien T Nguyen
(74) *Attorney, Agent, or Firm* — Nath, Goldberg & Meyer; Jerald L. Meyer; Ilirian Durri

(57) ABSTRACT

The present invention relates to a method for operating a ride (1) on a terrain (10) having at least one vehicle (20), the at least one vehicle (20) having a drive device (22), at least one passenger receptacle (21) for at least one passenger (5), and a store (24) that can be filled with projectiles (15), the method being characterized in that the at least one vehicle (20) is moved on the terrain by means of the relevant drive device (22) and in that at least one projectile (15) can be removed from the store (24) can be fired at the instigation of the at least one passenger (5). In addition, the present invention relates to a ride (1).

19 Claims, 3 Drawing Sheets

Figure 1:
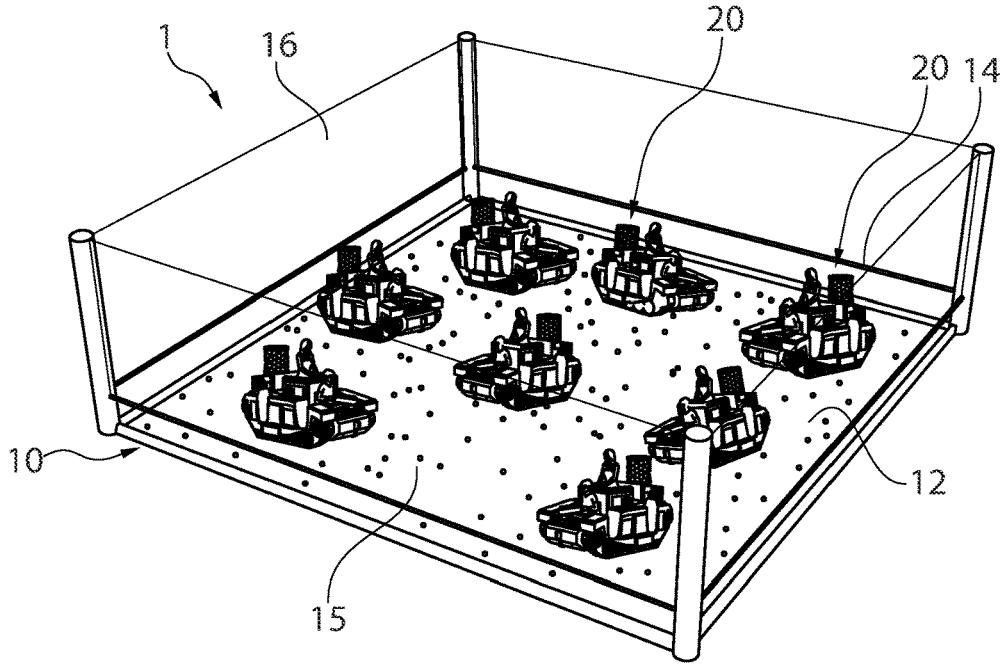

(51) Int. Cl.
*A63F 11/00* (2006.01)
*A63G 31/00* (2006.01)
*A63G 33/00* (2006.01)

(52) U.S. Cl.
CPC ..... *A63F 9/0278* (2013.01); *A63F 11/0051* (2013.01); *A63G 31/007* (2013.01); *A63G 33/00* (2013.01); *A63F 2011/0058* (2013.01)

(58) Field of Classification Search
USPC ..... 472/43, 128
See application file for complete search history.

(56) References Cited

U.S. PATENT DOCUMENTS

2010/0053029 A1* 3/2010 Wilzbach ..... A63G 31/16 345/2.3
2018/0280789 A1 10/2018 Laidlaw et al.
2019/0255449 A1 8/2019 Hanna
2019/0366223 A1 12/2019 Sall et al.
2020/0306620 A1* 10/2020 Kennedy ..... A63F 11/0051

FOREIGN PATENT DOCUMENTS

JP 3625076 B2 3/2005
WO 2020201838 A1 10/2020

OTHER PUBLICATIONS

Office Action issue Sep. 28, 2021, in corresponding German application DE 102021101864.1.
Office action issued Feb. 20, 2023, in parallel pending Canadian patent application No. 3,145,060.

* cited by examiner

METHOD OF OPERATING A RIDE AND A RIDE

The present invention relates to a method for operating a ride having the features of claim 1 and to a ride having the features of claim 19.

Rides are known from the prior art in different designs. Such a ride is, for example, a bumper car, the ride being a stationary or semi-stationary apparatus and being found according to its intended use at fairs or in amusement parks. Rides of this kind have a plurality of vehicles comprising at least one passenger receptacle for at least one passenger, the at least one passenger being able to control the vehicle by means of a drive device. The vehicles are controlled by the at least one passenger and move on a predefined terrain. Depending on the preference of the at least one passenger, the journey over the terrain can be individually designed, the vehicles being secured by a wide circumferential rubber ring in case of any collisions.

Rides of this kind have proven successful in the past and enjoy great popularity. A disadvantage of such rides is that rides of this kind neither have means for quantitative recording of a game result nor require special coordination and skill. Rides of this kind also lack the possibility of a communal experience in which multiple passengers can achieve a common goal through coordinated behavior.

The present invention therefore addresses the object of proposing an improved method for operating a ride and an improved ride for passengers which expediently eliminates the disadvantages of the rides known from the prior art. The method to be proposed is intended to demand and promote a communal experience and passenger skill.

These objects are achieved by a method having the features of claim 1 and by a ride having the features of claim 19.

Further advantageous embodiments of the method and of the ride are specified in the dependent claims.

The method according to the invention having the features of claim 1 for operating a ride on a terrain having at least one vehicle, the at least one vehicle having a drive device, at least one passenger receptacle for at least one passenger, and a store that can be filled with projectiles, is characterized in that the at least one vehicle is moved on the terrain by means of a drive device and in that at least one projectile can be removed from the store and can be fired at the instigation of the at least one passenger.

The concept on which the invention is based for operating a ride is that the at least one passenger can remove at least one projectile, preferably a plurality of projectiles in succession, from the store of the relevant vehicle and can fire said projectile in the direction of the at least one second vehicle.

In connection with this invention, firing can be understood to mean that at least one projectile is either thrown by the at least one passenger and/or is moved, shot, or launched by technical means—as will be described later in detail.

In connection with this invention, a projectile can be understood to mean a body of any desired design. For example, the at least one projectile can be a softball, a handball, a soccer ball, a water bomb, a paintball, a golf ball, a rugby ball, a foam dart, rubber dart, and/or plastic dart or arrow and/or foam bullets. However, in connection with this invention, a bullet of a firearm is not understood to be a projectile.

The aim is to hit a further vehicle or a target element, for example, with the at least one projectile, in particular while the at least one vehicle is moving on the terrain.

Initially, the at least one vehicle is provided, preferably at an initial position, and preferably, when the at least one vehicle is provided, the store can be empty, partially filled, or fully filled. At least one passenger can take a seat on the relevant at least one passenger receptacle of the at least one vehicle. In the event that at least two vehicles are used to carry out the method, the at least two vehicles can preferably start in synchronization and then move—preferably freely—on the terrain.

The store can preferably accommodate and store at least one, preferably at least two, and even more preferably a large number of projectiles, and can further be configured in such a way that at least one projectile can be removed in order to fire said projectile at another vehicle or a target element.

According to a development of the method, the at least one vehicle has a firing device which can fire at least one projectile. The firing device can accelerate the projectile to perform a free flight in any way, the projectile preferably being accelerated by spring means and/or by compressed air. The spring means and/or the compressed air can impart a predefined kinetic energy on the projectile, as a result of which a risk of injury to the passengers can be minimized or excluded through suitable selection.

The firing device can be loaded manually as well as semi or fully automatically. Manual loading is to be understood to mean that the at least one passenger must remove each projectile from the store and insert the projectile into the firing device. In the case of semi-automatic loading, the at least one passenger must operate at least one mechanism in order to load a further projectile after a projectile has been fired. Fully automatic loading can take place after each shot, provided there is a projectile in the store. A projectile is reloaded into the firing device without the passenger's intervention. At this point, it is noted that the firing device within the meaning of this invention is not a firearm that, in particular, falls under laws concerning weapons or military weapons.

Preferably, the firing device can be manually oriented by the at least one passenger from the at least one passenger receptacle. The firing device can preferably be swiveled by 360° in the vertical axis of the vehicle and further preferably at a pitch angle of ±45°. It can also be advantageous if adjustment or targeting means are provided, by means of which the firing device can be oriented by the at least one passenger from the passenger receptacle.

According to a development of the method, the at least one vehicle can have at least two passenger receptacles, one of the at least two passenger receptacles having control means which can control the vehicle. The other of the at least two passenger receptacles can be arranged in such a way that the projectiles can be fired therefrom. The at least two passenger receptacles are preferably arranged in such a way that the passengers can communicate with one another. It is possible to divide up tasks in a vehicle designed in this way. One of the at least two passengers controls the vehicle, while the other of the at least two passengers attempts to throw or fire projectiles from the store at the at least one second other vehicle. The two passengers of the one of the at least two vehicles must cooperate well as a team in order to achieve a good game result. This creates a communal experience and increases the experience value.

It has proven to be advantageous if at least one of the at least two passenger receptacles is a standing space. Preferably, one passenger receptacle is a seat and the other passenger receptacle is a standing space, the passenger receptacle further preferably being a standing space from which the projectiles are fired at the instigation of the passenger, and the passenger receptacle being a seat from which the vehicle is controlled. Each passenger receptacle can have a suitable restraining device, such as a belt, a strap, and/or a linkage.

According to a preferred development of the present invention, the at least one vehicle has a collecting device for collecting projectiles, it being possible for the collecting device to feed the collected projectiles to the store. In order for a sufficient number of projectiles to be available to the relevant passenger in the store, the at least one passenger must collect projectiles by means of the collecting device. Said passenger is therefore forced to move the vehicle over the terrain. The collecting device can collect the projectiles from the terrain in a variety of ways, for example by means of an intake, a magnetic system, a collecting roller, or an extruder. The collected projectiles are deposited in the store or fed to the store and can then be used for throwing or firing at the at least one further vehicle and/or a target.

In one embodiment of the method, the collecting device comprises a preferably funnel-shaped slide which is arranged in a front side area and/or rear side area of each vehicle. The slide aids the collection of projectiles from the terrain.

It has proven to be advantageous if the at least one vehicle is an autonomous vehicle. The vehicle can be moved over the terrain without the intervention of the at least one passenger, as a result of which the entertainment value can be increased for the at least one passenger due to unforeseeable driving maneuvers. Using suitable sensors, the autonomous vehicle can search the environment on the terrain for projectiles lying around and drive to collect them in a targeted manner, a vehicle controller or a higher-level controller and/or, for example, environment monitoring means, which are described further below, monitoring compliance with a minimum distance from the other vehicles and/or objects on the terrain and/or the perimeter of the terrain.

According to a development of the method, the at least one vehicle can follow a course. The course can be self-contained and specify a route along which the vehicles must move in the course of a journey. The course can be indicated by a wall, geofence, marking, or the like. The course can have artificial and natural obstacles, mise-en-scène, or the like in order to increase the entertainment value of the journey. The at least one vehicle can repeatedly follow the course, a station being provided that includes an entrance and exit for passengers for the ride.

Furthermore, it can be advantageous if at least one target element is provided. The at least one target element can have, for example, a basketball hoop, a folding target, a gate, a can tower, or any other design in order to form a suitable target at which to throw or fire at least one projectile. The target element can also comprise at least one firing device for projectiles and, for example as a reactive response, fire at the at least one vehicle.

According to a development of the method, the vehicle has at least one environment monitoring means. The environment monitoring means can comprise distance sensors which can detect when a minimum safety distance from another vehicle, from objects, or persons on the terrain, or a wall or boundary of the terrain, is no longer being met. If a minimum safety distance is no longer being met, it is possible to work toward maintaining the minimum distance by means of appropriate control commands to the drive device. Undesired collisions are prevented by the environment monitoring means.

According to a development of the method, hit detection means are provided, the hit detection means being able to detect a corresponding hit of the at least one vehicle and/or the at least one target element. When a projectile impacts the relevant vehicle and/or the at least one target element, a corresponding hit reaction can be generated, by means of which the hit can be perceived optically, haptically, and/or acoustically. The hit detection means can provide an objective assessment or identification of a hit.

According to a preferred development of the method according to the invention, the hit reaction comprises a predetermined vehicle movement by the drive device. For example, the hit reaction can comprise at least one rotation about a vertical axis of the relevant vehicle, or a fixing or stopping of the relevant vehicle at a position on the terrain, in particular over a predefined time.

According to an advantageous development of the method according to the invention, the hit reaction comprises an acoustic, haptic, and/or optical signal. An acoustic signal can be generated, for example, by a sound generator, while the optical signal can be generated, for example, by lamps or a mist generator. A haptic signal can be generated, for example, by an actuator, a vibration generator, or the like. Both the above-described predetermined vehicle movement and the haptic, acoustic, and/or optical signal can be generated synchronously and produce a haptically, acoustically, and/or optically appealing effect.

When carrying out the method, it has proven to be advantageous if the hit detection means detect a hit position on the at least one vehicle and/or on the at least one target element. By detecting the hit position, it can be the case, for example, that only hits in an area, surface, and/or part generate a hit reaction, for example those hits which occur or are marked centrally on the at least one vehicle and/or the at least one target element. By detecting the hit position, passengers are encouraged to aim the projectiles as precisely as possible in order to make an effective hit. Projectiles lying around that collide with the vehicle while driving or poorly targeted projectiles are not counted or are counted to a lesser degree. In particular, it is preferred if, by detecting the hit position, only the hits which hit the at least one vehicle and/or the at least one target element in areas intended therefor, for example centrally and/or adjacent to the at least one passenger receptacle, trigger a hit reaction.

Furthermore, it is advantageous if the hit detection means are used to determine a game result. For example, the number of hits detected by the hit detection means can be counted, as a result of which a game result can be assigned to the at least one vehicle or to the relevant vehicle in the case of multiple vehicles.

In addition, it has proven to be advantageous if the game result depends on the hit position. For example, the relevant vehicle can be divided into multiple hit zones. For example, in the event of a hit, different points can be scored in the different hit zones, which points are attributed to the game result. For example, hits close to the ground may score fewer points than hits in the vicinity of the at least one passenger receptacle and/or in the center of the at least one target element. This encourages passengers to aim as precisely as possible and to make a particularly precise hit.

Furthermore, according to the method, the game result is attributed either to the at least one vehicle from which the projectile was conveyed against the other of the at least two vehicles and/or the at least one target element. In the case of at least two vehicles, each of the at least two vehicles can only receive a specific number of hits or points. If the specific number of hits or points is reached, it can be "game over" for the relevant vehicle. In such a case, the store can be closed by means of closing means. The vehicle can remain still or return to a starting position.

In the event that the ride has more than two vehicles, it may be advantageous if the vehicles are divided into two groups or teams. The different groups or teams of vehicles can be color-coded. Furthermore, the projectiles of the relevant vehicle are preferably identifiable. Identification can occur electronically. For example, an assignment can be performed in the relevant vehicle, the assignment being performed via a code, tag, or chip. The hit detection means can identify the impacting projectile, for example by reading out the tag, code, or chip, and an assignment, for example by means of a higher-level controller, can be performed.

It may also be advantageous if the hit detection means detect a hit intensity or a hit impetus. In a preferred development, the strength of the hit can be factored into the game result, as a result of which, for example, particularly weak hits do not result in a score, while strong hits with a high impetus result in a better score or more points.

It may prove to be advantageous if at least two vehicles are provided. Furthermore, it is advantageous if the at least one or the at least two vehicles communicate with the higher-level controller. State information can be transmitted to the higher-level controller, the state information being able to comprise the vehicle position, data of the hit detection means, or vehicle parameters. The higher-level controller can also send control commands to the at least one vehicle. For example, the higher-level controller can temporarily or permanently control the drive device. Temporary control can, for example, return at least one vehicle autonomously to an initial position after completion of the game or in the event of "game over". Permanent control can drive the at least one vehicle autonomously during the game, for example as a "trackless vehicle". The at least one passenger can then concentrate completely on conveying the projectiles to a further vehicle and/or to the at least one target element.

Furthermore, it is advantageous if the at least one vehicle can drive in water. For example, it may be advantageous if the terrain is flooded with water or a driving level is lowered into a water basin. As a result, the play and fun factor can be increased considerably, in particular in warm seasons.

The driving level can be designed in the manner of a perforated sheet or grid and can be raised and lowered by a lifting device. Such a ride can be used both as a "dry" ride and as a wet "water ride", as desired. The at least one vehicle can be designed in such a way that it is permanently supported on the driving level and can be driven by means of traction. This ensures that the least one vehicle stands securely and ensures fast and dynamic mobility, in particular maneuverability. In addition, the ride is versatile. However, it is noted at this point that the at least one vehicle can swim equally well and can be moved by means of a corresponding water drive such as a jet drive, propeller drive, or the like.

Furthermore, it is preferred if the at least one vehicle is moved on the terrain by means of the drive device by means of a chain drive. In particular, a chain drive enables vehicle movements which cannot be performed by conventional multi-axle vehicles that have only one steerable axle, for example rotation at a position about the vertical axis.

According to a further preferred development of the present invention, absorbent projectiles are used for carrying out the method. Absorbent projectiles can, for example, comprise a foam layer or be formed from foam material. The projectiles in general can be bodies of any design, such as softballs, balls, darts, or foam bullets.

Furthermore, supply means can be provided which are configured to supply the at least one vehicle with operating materials, in particular energy and/or projectiles. The supply means are preferably arranged at the initial position. Furthermore, the supply means can supply the vehicle with electrical energy or charge a power storage medium or a voltage source of the at least one vehicle or supply the at least one vehicle with compressed air for the firing device. The supply means can also hold projectiles for the relevant vehicle.

A further aspect of the present invention relates to a ride for operation on a terrain, in particular for carrying out the above-described method, having at least one vehicle, preferably at least two vehicles, the at least one vehicle having a drive device, at least one passenger receptacle for at least one passenger, and a store that can be filled with projectiles, it being possible for at least one projectile to be removed from the store and fired at the instigation of at least one passenger.

The firing of the at least one projectile can be carried out by the at least one passenger by throwing and/or it can be fired by means of a firing device. The firing device preferably comprises means for accelerating the projectile, the means being, for example, compressed air or springs. Using the means for accelerating the projectile, the kinetic energy of the projectile can be determined when a shot is a fired; this can reduce any risk of injury.

The firing device of the at least one vehicle can preferably be triggered by the at least one passenger from the at least one passenger receptacle using actuating means, the actuating means further preferably allowing manual loading of the cannon, semi-automatic loading of the cannon, or fully automatic loading of the cannon.

Furthermore, it is advantageous if the firing device can be manually oriented by the at least one passenger from the at least one passenger receptacle, or if the firing device can be oriented by the at least one passenger using adjustment or targeting means.

According to a preferred development of the present invention, the at least one vehicle has at least two passenger receptacles. According to a further embodiment, one of the at least two passenger receptacles can have control means which can control the vehicle. The at least two passenger receptacles are preferably arranged in such a way that the passengers can communicate with one another. It is possible to divide up tasks in a vehicle designed in this way. One of the at least two passengers controls the vehicle, while the other of the at least two passengers attempts to fire or throw projectiles from the store at the at least one second other vehicle. The two passengers of the one of the at least two vehicles must cooperate well as a team in order to achieve a good game result. This creates a communal experience and increases the experience value.

It has proven to be advantageous if at least one of the at least two passenger receptacles is a standing space. Preferably, one passenger receptacle is a standing space and the other passenger receptacle is a seat. The vehicle can preferably be controlled from the seat and, further preferably, the projectiles can be fired from the standing space at the instigation of the passenger. Each passenger receptacle can have a suitable restraining device, such as a belt, a strap, and/or a linkage.

Furthermore, it has proven to be advantageous if the at least one vehicle has a collecting device which is configured to collect projectiles from the terrain and to supply them to the store. The collecting device can, for example, suck in balls from the terrain and feed them to the store. The collecting device can also comprise an extruder and/or have a preferably funnel-shaped shield in a front side area and/or rear side area of the vehicle. By means of the collecting device, the vehicle can independently pick up projectiles on the terrain and the store can be refilled while driving.

Furthermore, it can be advantageous if the at least one vehicle has environment monitoring means.

According to one development, the at least one vehicle can be an autonomous vehicle. Using suitable sensors, the autonomous vehicle can search the environment on the terrain for projectiles lying around and drive to collect them in a targeted manner, the higher-level controller and/or environment monitoring means monitoring compliance with a minimum distance from the other vehicles and/or objects on the terrain and/or the perimeter of the terrain.

The environment monitoring means of the at least one vehicle are substantially safety devices which are intended to prevent the vehicle from colliding with objects or other vehicles. In particular, it is advantageous if the environment monitoring means comprise distance sensors or the like. The vehicle can therefore be an intelligent vehicle that also watches out for collisions.

Furthermore, it can be advantageous if the ride comprises at least one target element. The at least one target element can form any desired target at which to throw or fire at least one projectile and be designed, for example, as a basketball hoop, folding target, gate, or can tower. The target elements can also be movable. For example, the at least one target element can move back and forth, swing, sway, and/or perform abrupt movements, which increases the degree of difficulty and the challenge for the at least one passenger. The target element can also comprise at least one firing device for projectiles and, for example as a reactive response, fire at the at least one vehicle.

In addition, it has proven to be advantageous if hit detection means are provided. The hit detection means can cause a hit reaction if the hit detection means detects the impact of a projectile on the at least one vehicle and/or on the at least one target element. The at least one vehicle and/or the at least one target element can comprise the hit detection means, the ride additionally being able to comprise hit detection means which monitor the at least one vehicle and/or the at least one target element.

The present ride makes it possible for at least one—preferably at least two—vehicles to move freely on the terrain, with the relevant passenger being able to cause at least one projectile to be removed from the filled store and conveyed to the relevant other vehicle. As soon as a projectile impacts the relevant other vehicle, the hit detection means can detect the impact of the projectile and can furthermore cause a hit reaction, which can be perceived haptically, optically, and/or acoustically.

According to a preferred development of the ride according to the invention, the hit detection means can send control commands to the drive device of the at least one vehicle. For example, the hit reaction can send a control command to the drive device of the at least one vehicle, which causes the relevant vehicle to rotate preferably by 360° about its own vertical axis, to accelerate, decelerate, and/or to be fixed in place for a certain duration.

According to a preferred embodiment of the ride, acoustic, haptic, and/or optical signal generation means can be provided. The acoustic and/or optical signal generation means can comprise a sound generator, lamps, vibration generators, an actuator, and/or a mist generator.

Furthermore, according to a development, the at least one vehicle can be connected to a higher-level controller. The at least one vehicle can, for example, transmit state information to the higher-level controller. State information can comprise, for example, a position on the terrain, number of hits, hit position, hit energy, or the like. Communication with the higher-level controller can take place bidirectionally, the higher-level controller being able, for example, to send control commands to the relevant drive device of the vehicle in order to prevent collisions, for example, or to cause the vehicle to automatically return to a starting point at the end of the game. The higher-level controller can also monitor and maintain a minimum distance between at least two vehicles, to a wall, or to a target element. For example, the at least one vehicle can move by means of the higher-level controller within a predefined "geofence". The at least one vehicle therefore cannot leave a specific area of the terrain. The higher-level controller can also provide autonomous or semi-autonomous control of the at least one vehicle and/or monitor autonomous movement of the at least one vehicle.

Furthermore, it has proven to be advantageous if the hit detection means detect at least one sensor for detecting a hit and/or hit position. The at least one sensor can, for example, determine the hit position on the relevant vehicle, as a result of which, for example, poorly positioned hits or collisions with projectiles lying around cannot be counted as hits. The hit detection means or the at least one sensor of the hit detection means can also determine a hit intensity or a hit impetus, as a result of which, for example, a game result can also be weighted.

It can be advantageous if the ride comprises at least two vehicles.

It may prove to be advantageous if the at least one vehicle, preferably the at least two vehicles, communicate with the highe/r-level controller. State information can be transmitted to the higher-level controller, the state information being able to comprise the vehicle position, data of the hit detection means, or vehicle parameters. The higher-level controller can also send control commands to the at least one of the at least two vehicles. For example, the higher-level controller can temporarily or permanently control the drive device. Temporary control can, for example, return vehicles autonomously to an initial position after completion of the game or in the event of "game over". Permanent control can drive the vehicles autonomously during the game—as previously described—for example as a "trackless vehicle". The at least one passenger can then concentrate completely on conveying the projectiles to another vehicle and/or to the at least one target element.

Furthermore, it is advantageous if the vehicle can drive in water. For example, it may be advantageous if the terrain is flooded with water or a driving level can be lowered into an underlying water basin. As a result, the play and fun factor can be increased considerably, in particular in warm seasons.

The driving level can be designed in the manner of a perforated sheet or grid and can be raised and lowered by a lifting device. Such a ride can be used both as a "dry" ride and as a wet "water ride", as desired. The at least one vehicle is preferably designed in such a way that it is permanently supported on the driving level and can be driven by means of traction. This ensures that the vehicle stands securely and ensures fast and dynamic mobility, in particular maneuverability, and, in addition, the ride is versatile. However, it is noted at this point that the at least one vehicle can swim equally well and can be moved by means of a corresponding water drive such as a jet drive, propeller drive, or the like.

Furthermore, it is preferred if the at least one vehicle is moved on the terrain by means of the drive device by means of a chain drive. In particular, a chain drive enables vehicle movements which cannot be performed by conventional multi-axle vehicles that have only one steerable axle, for example rotation at a position about the vertical axis.

According to a development, the ride can comprise a course. The course can be self-contained and specify a route along which the vehicles must move in the course of a journey. The course can be indicated by a wall, geofence, marking, or the like. The course can have artificial and natural obstacles, mise-en-scène, or the like in order to increase the entertainment value of the journey. The at least one vehicle can repeatedly follow the course, a station being provided that includes an entrance and exit for passengers for the ride.

Furthermore, the ride can comprise supply means which are configured to provide operating materials, in particular energy and/or projectiles, for the at least one vehicle. The supply means are preferably arranged at the initial position of the ride. Furthermore, the supply means can supply the vehicle with electrical energy or charge a power storage medium of the vehicle or supply a compressed air reservoir of the vehicle with compressed air. The compressed air reservoir can provide compressed air for the firing of the projectiles. The supply means can also hold projectiles for the relevant vehicle.

Figure 2:
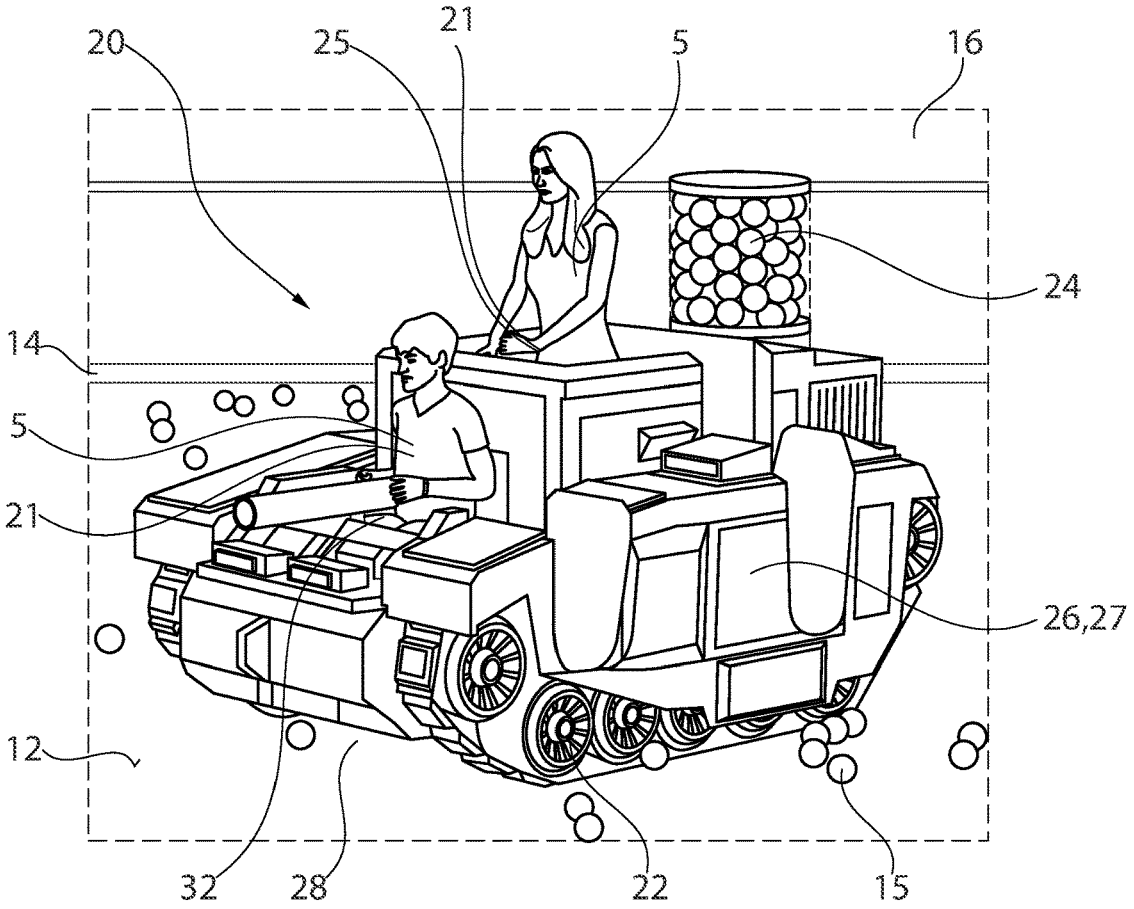
Figure 3:
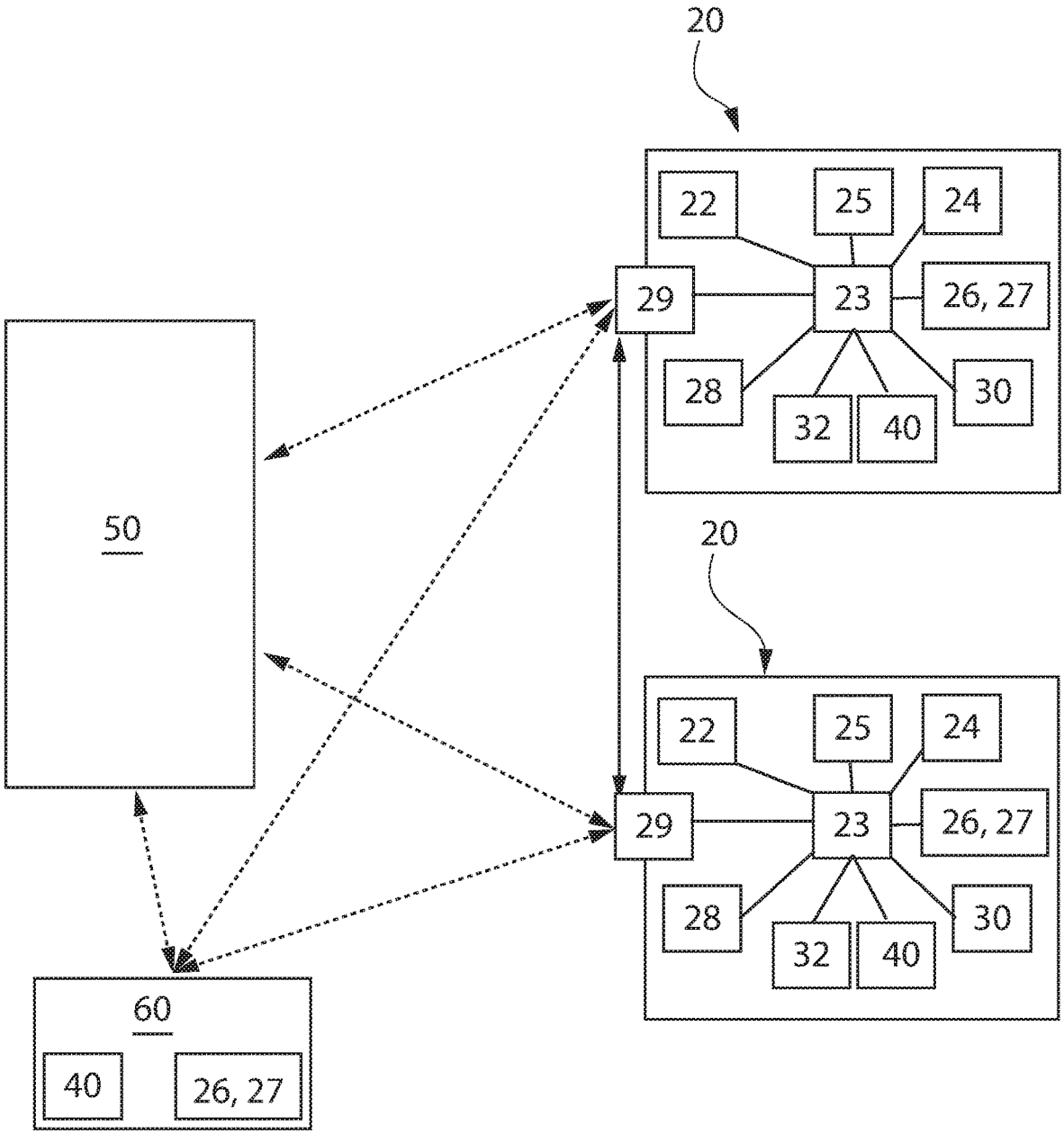
Figure 4:
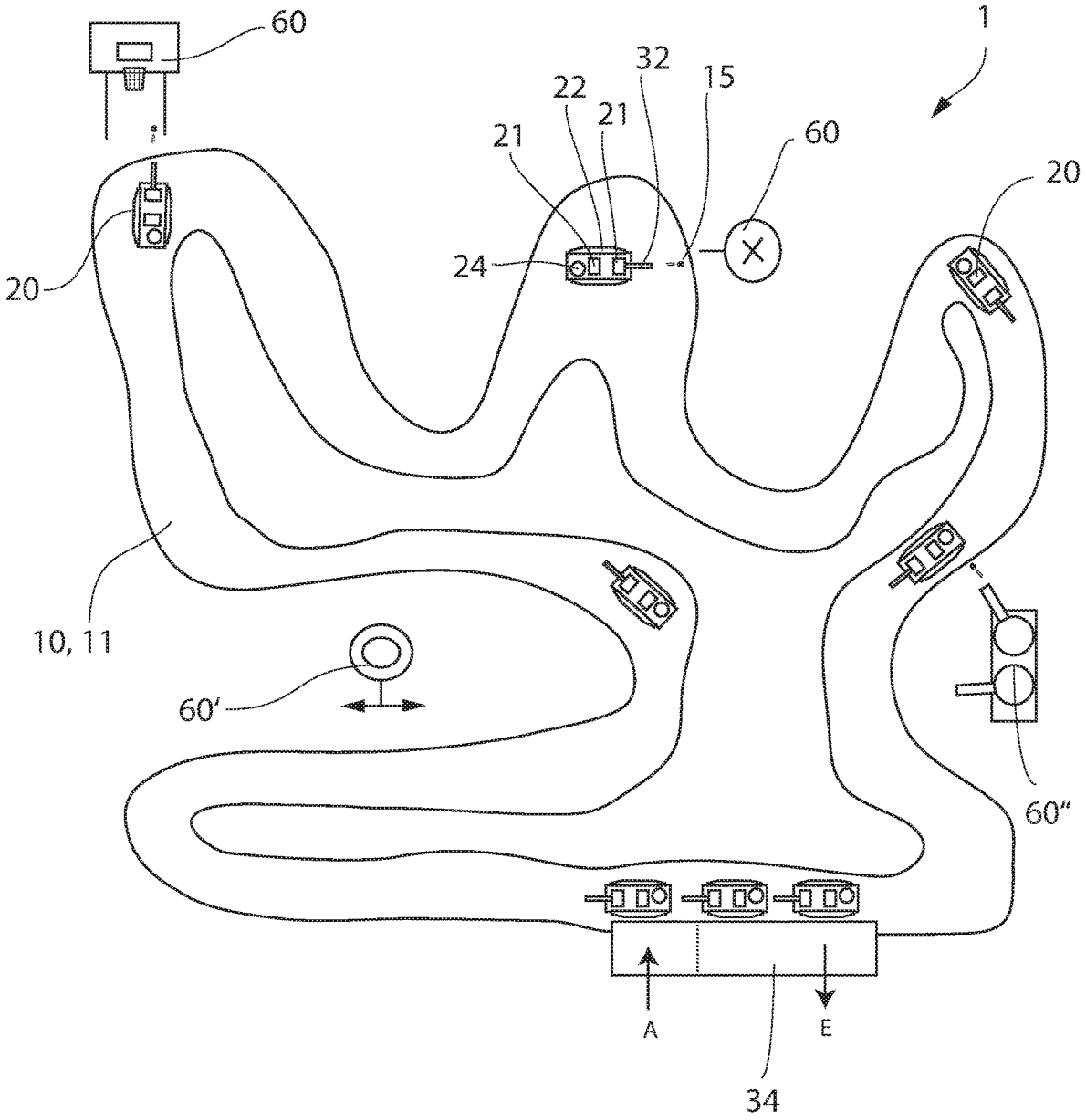

Two exemplary embodiments of a ride are described in detail below with reference to the accompanying drawings, in which:

FIG. 1 is a perspective representation of a ride having a plurality of vehicles, FIG. 2 is an enlarged representation of a vehicle according to FIG. 1 having two passenger receptacles and a store, a passenger being able to remove projectiles from the store, and FIG. 3 is a schematic and greatly simplified representation of the ride according to FIG. 1 and the vehicles according to FIG. 2, FIG. 4 is a schematic and greatly simplified representation of a second embodiment of the ride having a course.

Identical or functionally identical components are identified below with the same reference symbols. For the sake of clarity, not all parts that are identical or functionally identical in the individual Figures are provided with a reference number.

FIG. 1 is an exemplary representation of a ride 1, having a terrain 10 and a plurality of vehicles 20, which can be moved—preferably freely—on the terrain 10 by means of a drive device 22, which is not shown in detail. The ride 1 can also have a large number of projectiles 15.

The projectiles 15 can be balls, darts, or softballs, preferably made of a foam material. Furthermore, the projectiles can be buoyant and preferably absorbent at least in a covering region in order to be able to absorb water.

The terrain 10 comprises a driving level 12 and preferably a wall 14 which surrounds the driving level 12. The wall 14 can also have padding in order to cushion collisions with a vehicle 20. Furthermore, the wall 14 can comprise a net 16.

The ride 1 can comprise a plurality of vehicles 20 and, preferably, it is possible to divide the vehicles 20 into at least two teams or groups. Each team or each group of vehicles 20 can be differentiated visually, for example by the color of the vehicles 20. In addition, it may be advantageous if the vehicles 20 are identical in design.

Each vehicle 20 has a front side area and a rear side area as well as at least one passenger receptacle 21 for a passenger 5, the above-mentioned drive device 22, a store 24, a vehicle control device 25, a firing device 32, and a collecting device 28.

It can be seen in FIG. 2 that, in accordance with the exemplary embodiment shown, the vehicles 20 in the exemplary embodiment shown have two passenger receptacles 21, for one passenger 5 each. One of the two passenger receptacles 21 can be a standing space and can be arranged further centrally between the front side area and the rear side area of the vehicle 20, in particular adjacent to the vehicle control device 25, and allows the passenger 5 to control vehicle 20 from the passenger receptacle 21 with good all-around visibility and/or to operate the drive device 22. The drive device 22 can comprise a motor (not shown), in particular an electric motor, and further preferably comprises a caterpillar chassis driven by the drive. The drive device 22 is configured to move the relevant vehicle 20 by traction over the terrain 10 or over the driving level 12. Alternatively, the drive device 22 can have a wheel chassis, the respective wheels preferably being steerable and/or drivable, as a result of which the vehicle 20 can have a particularly high maneuverability.

At least one vehicle 20 can have a firing device 32. The firing device 32 can fire at least one projectile 15 and accelerate the at least one projectile 15 in any desired manner to perform a free flight. For this purpose, the firing device 32 can accelerate the projectile 15 by spring means and/or by means of compressed air and impart a predefined kinetic energy on the projectile 15. The compressed air for the firing device 32 can be provided by a compressed air reservoir (not shown) in the vehicle.

The firing device 32 can be loaded manually as well as semi or fully automatically. Manual loading is to be understood to mean that the at least one passenger 5 must remove each projectile 15 from the store 24 and insert the projectile 15 into the firing device 32. In the case of semi-automatic loading, the at least one passenger 5 must operate at least one mechanism in order to load a further projectile after a projectile has been fired. Fully automatic loading can take place after each shot, provided there is a projectile 15 in the store 24. A projectile 15 is reloaded into the firing device 32 without the passenger's 5 intervention.

The firing device 32 can be oriented in a fixed manner on the vehicle 20 or can be manually oriented from the at least one passenger receptacle 21. The firing device 32 can also be actuated by the at least one passenger 5 using adjustment or targeting means. As can also be seen in FIG. 2, the firing device 32 can be arranged in the front side area of the vehicle 20, preferably together with the at least one passenger receptacle 21. These passenger receptacles 21 can be designed as a seat.

The supply of electrical energy to each vehicle 20 can, to give examples, serve as a voltage source via a supplied power storage medium or can be provided by a current-carrying grid and a current collector. The grid can be arranged in the driving level or above the driving level 12 and is in electrical contact with the current collector of the vehicle 20.

Furthermore, it can be seen with reference to FIG. 2 that the vehicle 20 preferably has the collecting device 28 in the front side area, which device can collect one or more projectiles 15 from the terrain 10 and feed it/them to the store 24. The collecting device 28 can comprise a slide (not shown) by means of which the projectiles are guided to an extruder or an intake while the vehicle 20 is driving in an intended main direction of travel, the collecting device 28 depositing or providing collected projectiles 15 in the store 24. The slide can preferably be funnel-shaped or V-shaped.

The store 24 can be designed in the manner of a basket or container. The at least one passenger 5 can, from the passenger receptacle 21, remove projectiles 15 from the store 24 and convey them, for example by throwing, to the relevant other of the at least two vehicles.

Hit detection means 26 can also be provided. The hit detection means 26 can comprise one or more sensors 27 and can detect projectiles 15 that impact the vehicle 20. The hit detection means 26 preferably detect the hit and more preferably also the hit position of the projectiles 15 at different positions on the vehicle 20. For example, the sensors 27 can be pressure-sensitive in order to be able to determine, for example, the impetus of the impacting projectile 15. As a result, it may be possible to make a quantitative statement about the hit quality of the hit.

Furthermore, the vehicle 20 can have a controller 23, communication means 29, signal generation means 40, and/or environment monitoring means 30.

Using the communication means 29, the vehicle 20 can communicate, as shown in FIG. 3, with another vehicle 20, a higher-level controller 50 of the ride 1, and/or a target element 60, it being possible for state information to be transmitted. For example, data of the hit detection means 26, position data, or the like can be transmitted. The communication means 29 can also receive control commands of the higher-level controller 50. For example, the higher-level controller 50 and/or the controller 23 of each vehicle 20 can send control commands to the drive device 22.

The signal generation means 40 can generate an acoustic, haptic, and/or optical hit reaction. The signal generation means 40 can comprise a sound generator, lamps, a mist generator, and/or a pulse or vibration generator for generating a haptic effect. The signal generation means 40 can generate the hit reaction if a hit has been detected by the hit detection means 26. It is also possible for the hit detection means 26 to send control commands to the drive device 22. For example, in the event of a hit, the drive device 22 can be controlled in such a way that the vehicle 20 rotates about the vertical axis thereof on the driving level.

The environment monitoring means 30 monitor the surroundings of the relevant vehicle 20 and are intended to avoid collisions, in particular with other vehicles 20, passengers 5, and/or the wall 14.

The ride 1 can allow a communal experience for a plurality of passengers 5. Passengers 5 are divided into at least two teams or groups, the objective of the communal experience or the communal game being to throw as many projectiles 15 as possible at, and to hit, the vehicle 20 of the other group or the other team. During the communal experience or communal game, a method for operating the ride 1 is carried out as described below.

The ride 1 is operated intermittently or in phases, the method being interrupted between the phases so that passengers 5 can get in/out of the vehicles 20 or the passenger receptacles 21.

To carry out the method for operating the ride 1, at least two vehicles 20 are provided on the terrain. The passengers 5 can board the vehicles 20 either in the intended initial position or in an arbitrary position on the terrain 10. The initial positions are preferably arranged adjacent to an entrance or exit of the ride, the initial positions for the at least two groups or teams being arranged preferably on opposite sides of the terrain 10.

The stores 24 of the vehicles 20 can initially either be empty, partially filled, or fully filled.

During the communal game or the method, the vehicles 20 can move over the terrain 10. The vehicles 20 can be controlled on the terrain 10 either by a passenger 5 by means of the vehicle control device 25 or alternatively at least one of the at least two vehicles 20 can move autonomously over the terrain 10, for example as a "trackless vehicle".

The relevant at least one passenger 5 can remove projectiles 15 from the store 24 and convey them to or throw them at the relevant other of the at least two vehicles 20. If a projectile 15 hits the relevant vehicle 20, the hit is detected by hit detection means 26 and a hit reaction is generated.

The hit reaction can comprise a predetermined vehicle movement by means of the drive device 22 and/or one or more signals generated by the signal generation means 40. The hit reaction signals a hit.

The hit detection means 26 can detect both the hit position and/or the hit intensity or the impetus and can also be used to determine a game result, the game result preferably being dependent on the hit position and/or the hit intensity. The hit detection means 26 can transmit the hits to the higher-level controller 50 of the ride 1 using the communication means of the vehicle and the game result can be illustrated or displayed in a suitable manner.

While driving over the terrain 10, each vehicle 20 can collect projectiles 15 and provide or store them in the store 24 for the at least one passenger 5. To ensure that the store 24 is always sufficiently filled, the passenger 5 must move with their vehicle 20 over the terrain 10 in order to have a sufficient number of projectiles 15 in stock. The projectiles 15 can be picked up from the terrain 10 or the driving level 12 by the collecting device 28, which collecting device 28 can preferably pick up the projectiles 15 by means of an intake or an extruder.

Each vehicle 20 can be steered or moved on the terrain either by means of a vehicle control device 25 or autonomously. Environment monitoring means 30 preferably monitor a vicinity of the vehicle 20 and detect obstacles, other vehicles, or passengers on the terrain 10. The environment monitoring means 30 can be used to control the vehicle 20 and are intended to prevent collisions.

The communal experience ends preferably after a predefined time or when a predefined game result is achieved. As soon as the communal experience has ended, hits are no longer counted. The vehicles 20 either remain in place or are moved back to the relevant boarding zone autonomously or by the passenger 5.

According to a development (not shown) of the ride 1, the vehicles 20 move in water. For example, the terrain 10 or the driving level 12 can be flooded with water, the driving level 12 preferably being perforated or grid-like, it being possible for the driving level to be lowered below a water surface and raised above the water surface by a lifting device.

When the driving level 12 is in the raised state, each passenger 5 can get in and out of the relevant vehicle 20 with getting their feet wet, while the driving level 12 can be lowered during the communal game. When the driving level 12 is in the lowered state, the vehicles 20 preferably do not float. The vehicles 20 are still moved by traction, as a result of which the ride 1 can be operated both as a "dry" and as a "water" ride. The vehicles are always firmly on the driving level 12 and can be controlled or steered dynamically and directly. There is no risk of capsizing or overturning, rocking, or the like.

FIG. 4 shows a further embodiment of a ride 1. The ride 1 comprises a terrain 10, the terrain 10 comprising a course 11 which the at least one vehicle 20 can follow.

The course 11 can be formed by markings, a corresponding wall, and/or a geofence or the at least one vehicle 20 can follow the course 11 autonomously. The course 11 is preferably designed as a closed driving route, whereby continuous mass operation is possible and, additionally, a risk of collision between multiple vehicles 20 can be reduced. The journey can, for example, start and end at the initial position at a station 34, and supply means for the vehicle 20 can also be provided at the initial position. For better visitor flow control, the station 34 can have an entrance A and an exit E, which are preferably separate.

One or more target elements 60 can be arranged along the course 11 and the target elements 60 can have, for example, a basketball hoop, a folding target, a gate, a can tower, or any other design in order to form a suitable target at which to throw or fire at least one projectile 15. A target element 60, which is indicated by the reference sign 60', is designed to be movable and can be moved back and forth, swing, and/or perform abrupt movements by means of a movement device in order to increase the entertainment value and the degree of difficulty. The movement is indicated with double arrows. A further target element 60, which is indicated by the reference symbol 60", is arranged on the course 11 and can fire projectiles 15 in the direction of the course 11 or the passing vehicle 20.

The target elements 60 can, as shown by way of example in FIG. 3, comprise hit detection means 26, and detect a corresponding hit of the at least one target element 60. When a projectile 15 impacts the at least one target element 60, a corresponding hit reaction can be generated by the signal generation means 40, by means of which the hit can be perceived optically, haptically, and/or acoustically. To this end, the target element can comprise signal generation means 40. The hit detection means 26 can provide an objective assessment or identification of a hit of the target element 60 and a game result for the relevant vehicle 20 can be determined.

As indicated in FIG. 3 by means of double arrows, the vehicles 20 can communicate with each other, the vehicles 20 can communicate with the higher-level controller 50, the vehicles 20 can communicate with the target elements 60, and/or the target elements 60 can communicate with the higher-level controller 50.

The vehicle 20 can be designed analogously to the vehicle according to the first exemplary embodiment and can comprise a drive device 22 by means of which the vehicle 20 can be driven and moved along the course 11. The vehicle 20 can therefore either be an autonomous vehicle 20 or be controlled by a vehicle control device 25. The vehicle 20 preferably has two or more passenger receptacles 21. The vehicle control device 25 can be actuated from one of the two passenger receptacles 21 and the projectiles 15 can be fired from the other passenger receptacle 21.

The at least one projectile 15 can either be thrown by the at least one passenger 5 while traveling along the course 11 and/or be fired by the firing device 32 at the instigation of the passenger 5.

In this exemplary embodiment, a plurality of different game modes can be realized. For example, the aim of a journey on the ride can either be to score as many hits at the target elements 60 as possible while traveling along the course 11 or to drive through the course 11 as quickly as possible with a prescribed number of hits.

One of the challenges in these games can be, inter alia, that it is made more difficult to aim at the target elements 60 due to the fact that the vehicle 20 makes unforeseen movements. These vehicle movements can result either from control or steering movements or due to additional movements generated by the vehicle 20 that cannot be foreseen by the at least one passenger 5.

LIST OF REFERENCE SIGNS

5 Passenger
11 Course
15 Projectiles
20 Vehicles
20 Vehicle
20 Vehicles
21 Passenger receptacle
21 Passenger receptacles
22 Drive device
23 Controller
24 Store
25 Vehicle control device
26 Hit detection means
27 Sensors
28 Collecting device
29 Communication means
30 Environment monitoring means
32 Firing device
34 Station
40 Signal generation means
50 Controller
60 Target element
A Entrance
E Exit

The invention claimed is:

1. A method for operating a ride (1) on a terrain (10) having at least one vehicle (20), the at least one vehicle (20) having a drive device (22), at least one passenger receptacle (21) for at least one passenger (5), and a store (24) that can be filled with projectiles (15), characterized by the method comprising the steps of:

moving the at least one vehicle (20) on the terrain (10) by means of the drive device (22), and removing at least one projectile (15) from the store (24), the at least one passenger (5) throwing the at least one removed projectile (15) or firing the at least one removed projectile (15) by using a firing device (32) of the at least one vehicle (20), wherein a hit detection means (26) is provided on the at least one vehicle (20), and wherein the method further comprises the step of identifying a projectile (15) by reading out a tag, code, or chip when a hit of the projectile (15) is detected by the hit detecting means (26).

2. The method according to claim 1, characterized in that the firing of the at least one projectile (15) is carried out by a firing device (32) of the vehicle (20), and in that the firing device (32) can be triggered by the at least one passenger (5) by means of actuating means.

3. The method according to claim 2, characterized in that the firing device (32) can be manually oriented by the at least one passenger (5) from at least one passenger receptacle (21), or in that the firing device (32) can be oriented by the at least one passenger by adjustment means.

4. The method according to claim 1, characterized in that the at least one vehicle (20) has at least two passenger receptacles (21), it being possible to control the vehicle from a second of the at least two passenger receptacles (21) by means of a vehicle control device (25).

5. The method according to claim 4, characterized in that at least one of the at least two passenger receptacles (21) is a standing space.

6. The method according to claim 1, characterized in that the at least one vehicle (20) has a collecting device (28) for collecting projectiles (15), which device can preferably feed the projectiles (15) to the store (24).

7. The method according to claim 1, characterized in that the at least one vehicle (20) is moved autonomously on the terrain (10).

8. The method according to claim 1, characterized in that the at least one vehicle (20) can follow a course (11).

9. The method according to claim 1, characterized in that the at least one vehicle (20) has environment monitoring means (30).

10. The method according to claim 1, characterized in that at least one target element (60) is provided.

11. The method according to claim 10, characterized in that a hit reaction is generated when the hit detection means (26) detects the impact of a projectile (15) on the at least one vehicle (20) and/or on the at least one target element (60).

12. The method according to claim 11, characterized in that the hit reaction comprises a predetermined vehicle movement by the drive device (22).

13. The method according to claim 11, characterized in that the hit reaction comprises an acoustic and/or optical signal.

14. The method according to claim 11, characterized in that the hit detection means (26) detect a hit position.

15. The method according to claim 11, characterized in that hit detection means (26) are used for determining a game result.

16. The method according to claim 1, characterized in that the at least one vehicle (20) travels in water.

17. The method according to claim 1, characterized in that absorbent projectiles (15), in particular balls, softballs, darts, or foam bullets are used.

18. The method according to claim 1, characterized in that supply means are provided, and in that the supply means supply the at least one vehicle (20) with operating materials, in particular energy and/or projectiles (15).

19. A ride (1), in particular for carrying out the method according to claim 1, for operation on a terrain (10), having at least one vehicle (20), wherein the at least vehicle (20) has a drive device (22), at least one passenger receptacle (21) for at least one passenger (5), a store (24) that can be filled with projectiles (15), a hit detection means (26) and a firing device (32), wherein at least one projectile (15) can be removed from the store (24) and can be thrown by the at least one passenger (5) or fired by the at least one passenger (5) by using the firing device (32).

* * * * *